US005129270A

United States Patent [19]

Hasebe

[11] Patent Number: 5,129,270

[45] Date of Patent: Jul. 14, 1992

[54] STARTER WITH SPEED REDUCTION MECHANISM

[75] Inventor: Nobutoshi Hasebe, Ibaraki, Japan

[73] Assignee: Hitachi, Ltd., Tokyo, Japan

[21] Appl. No.: 636,242

[22] Filed: Dec. 31, 1990

Related U.S. Application Data

[63] Continuation of Ser. No. 232,764, Aug. 16, 1988, abandoned.

[30] Foreign Application Priority Data

Aug. 26, 1987 [JP] Japan ..... 62-210057

[51] Int. Cl.[5] ..... F02N 11/00

[52] U.S. Cl. ..... 74/7 R; 74/7 C; 74/7 E

[58] Field of Search ..... 74/7 R, 7 A, 7 C, 7 E

[56] References Cited

U.S. PATENT DOCUMENTS

| | | | |
|---|---|---|---|
| 1,776,228 | 9/1930 | Coffman | 74/7 C X |
| 1,893,959 | 1/1933 | Patterson | 74/7 R |
| 2,356,503 | 8/1944 | Callsen et al. | 74/6 |
| 4,699,095 | 10/1987 | Klie et al. | 74/7 E X |
| 4,776,224 | 10/1988 | Maezawa et al. | 74/7 E |

FOREIGN PATENT DOCUMENTS

| | | | |
|---|---|---|---|
| 311062 | 1/1918 | Fed. Rep. of Germany | 74/7 R |
| 458058 | 3/1928 | Fed. Rep. of Germany . | |
| 3136123 | 11/1984 | Fed. Rep. of Germany . | |
| 51-143113 | 5/1975 | Japan . | |

*Primary Examiner*—Allan D. Herrmann
*Assistant Examiner*—David W. Laub
*Attorney, Agent, or Firm*—Antonelli, Terry, Stout & Kraus

[57] ABSTRACT

A starter with a reduction mechanism provided between a motor and a pinion clutch includes a pinion shaft mechanically coupled to the inner portion periphery of a clutch inner of the pinion clutch in such a manner as to be movable in the axial direction thereof, and a pinion provided at one end of the pinion shaft. The starter further, includes first helical splines provided between the clutch inner portion of the pinion clutch and the pinion shaft, and second helical splines provided at one end of the pinion shaft such that the pinion shaft is mechanically coupled to the pinion therethrough.

21 Claims, 3 Drawing Sheets

STARTER WITH SPEED REDUCTION MECHANISM

This is a continuation of U.S. application Ser. No. 232,764, filed Aug. 16, 1988, now abandoned.

BACKGROUND OF THE INVENTION

1. Field of the Invention

The present invention relates to a pinion engaging mechanism for a starter with a reduction mechanism, and, more paticularly, to a starter with a reduction mechanism which has a highly reliable pinion engaging mechanism.

2. Description of the Prior Art

In the conventional starters, such as, for example, Japanese Utility Model Laid-Open Publication No. 51-143113, a pinion engagement is conducted by at least a first spline provided between a pinion shaft and a clutch inner portion, and straight splines or spur splines are disposed for the purpose of coupling the pinion to the pinion shaft in the circumferential direction alone.

The above-described pinion engaging mechanism gives no consideration to the engagement of the pinion with a ring gear to abut each other at the corner portion of the spur gear, and suffers from a problem involving reliability of engagement.

SUMMARY OF THE INVENTION

In view of the above problem in the prior art, an object of the present invention is to provide a stater with a reduction mechanism which is free from engagement errors and which can provide an excellent engagement.

To this end, the present invention provides a starter with a reduction mechanism provided between a motor and a pinion clutch which includes a pinion shaft mechanically coupled to an inner periphery of a clutch inner means of the pinion clutch in such a manner as to be movable in an axial direction thereof, and a pinion provided at one end of the pinion shaft, wherein at least a first helical spline is provided between the clutch inner means of the pinion clutch and the pinion shaft, and at least a second helical spline is provided at one end of the pinion shaft such that the pinion shaft is mechanically coupled to the pinion through the second helical spline.

In the starter with the reduction mechanism of the present invention, the pinion makes contact with the end face of a ring gear in the axial direction while being rotated by the power of a motor which is transmitted through the second helical spline provided at one end of the pinion shaft. When it abuts against the corner portion of the spur gear in the circumferential direction, the pinion is shifted in the direction in which it is separated from the corner portion of the spur gear by the action of the second helical spline so as to eliminate pinion engagement errors.

DETAILED DESCRIPTION OF THE PREFERRED EMBODIMENTS

Figure 1:
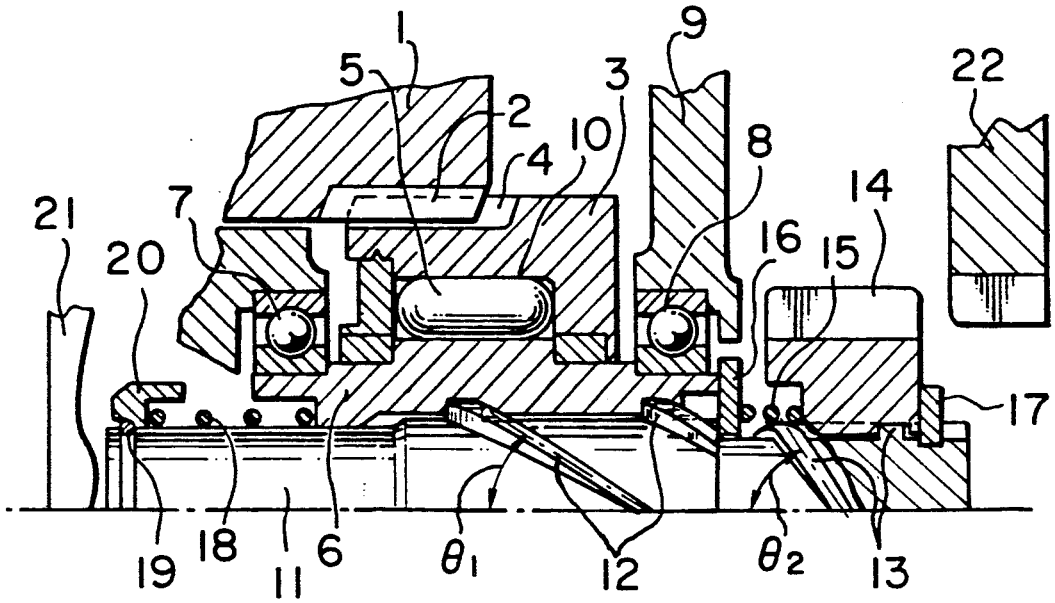
FIG. 1 is a sectional view taken along the axial direction of a pinion engaging mechanism for a starter with a reduction mechanism according to the invention.
Figure 2:
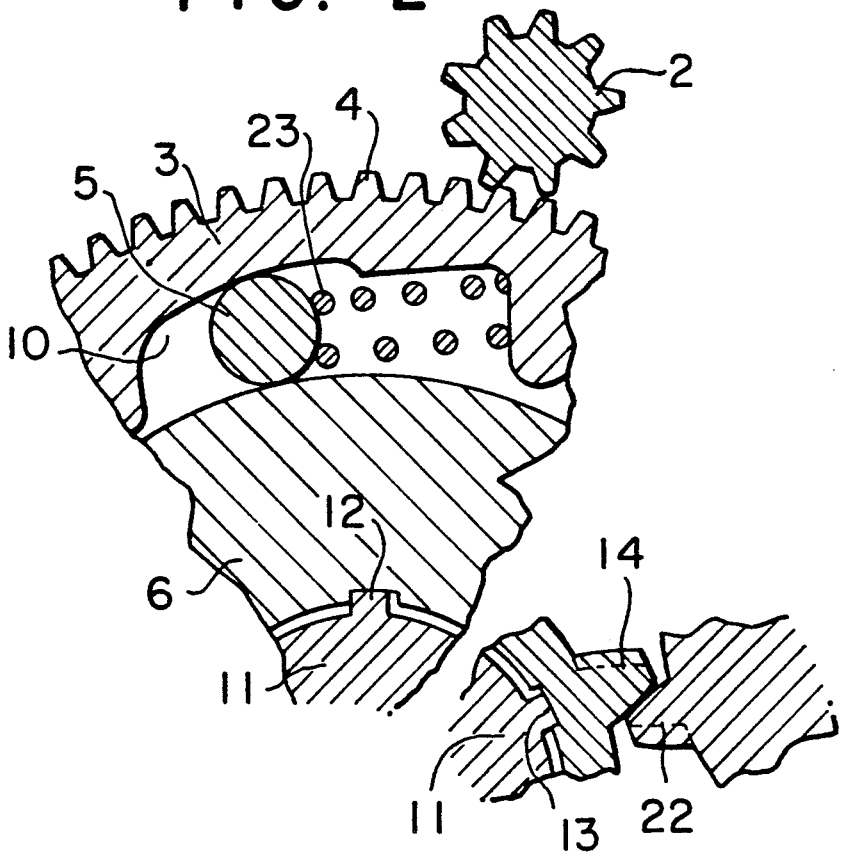
FIG. 2 is a sectional view taken along the circumferential direction of the pinion engaging mechanism shown in FIG. 1.

Referring to the drawings wherein like reference numerals are used throughout the various views to designate like parts and, more particularly, to FIG. 1, according to this figure, a DC motor, serving as a starter, includes a shaft 1, with an armature gear 2 provided at one end of the shaft 1 and a clutch gear 4 provided at the outer periphery of a clutch outer means 3 of a pinion clutch. The armature gear 2 and clutch gear 4 form a reduction mechanism. Both ends of a clutch inner means 6 are retained in a housing 9 through ball bearings 7, 8. A one-way clutch mechanism is formed by the outer periphery of the clutch inner means 6, a roller 5, and the clutch profile provided on the inner periphery of the clutch outer means 3.

a pinion shaft 11 is coupled to the clutch inner means 6 through first helical splines 12. The first helical splines 12 are twisted by an angle $\theta_1$ in the direction opposite to the direction in which the pinion shaft 11 of the starter which transmits power to an engine is rotated. The pinion shaft 11 is, further, provided at the distal end with a pinion 14 through second helical splines 13. The second helical splines 13 are rotated in the same direction as that in which the first helical splines 12 are rotated, and are twisted by an angle $\theta_2$, where $\theta_2$ is larger than $\theta_1$.

A sleeve spring 15, sleeve washer 16, and stopper clip 17 are provided, with the pinion 14 being prevented from moving in the axial direction by the sleeve spring 15.

Figure 3:
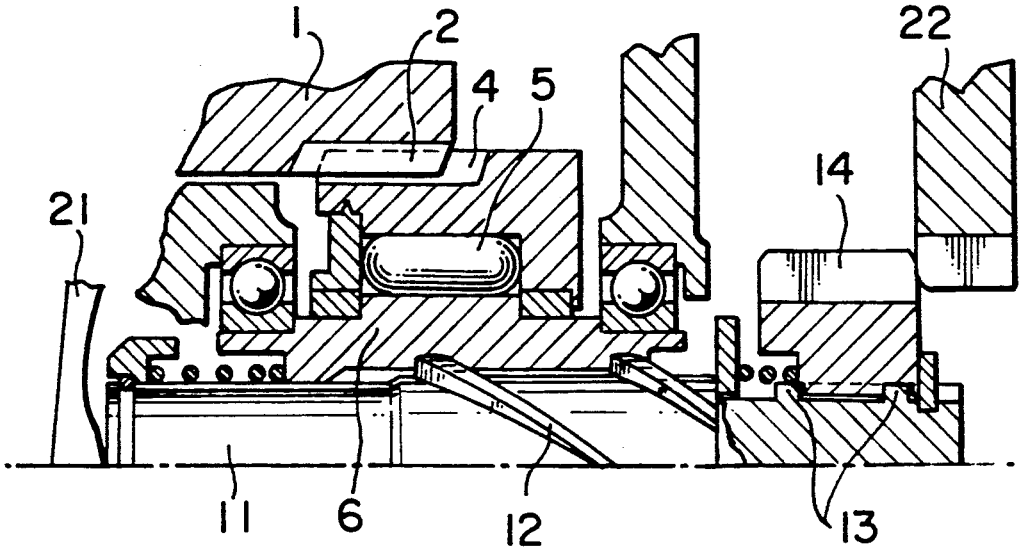
FIG. 3 is a cross-sectional view in a state wherein a pinion is in contact wit an corner portion of a gear.
Figure 4:
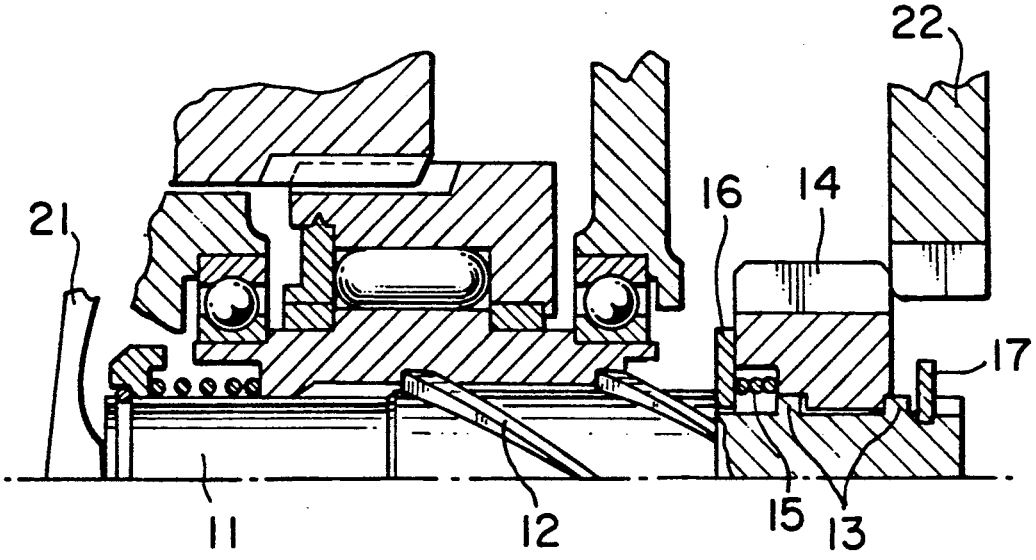
FIG. 4 and 5 are cross-sectional views in a state wherein the contact of the pinion with the corner portion is released.

As shown in FIGS. 1, 3 and 4, the pinion shaft 11 is stepped or has portions thereof of a different diameter, with the stepped portions forming a support means for the respective splines 12, 13, and with the washer 16 being arranged on the pinion shaft and engaged with an end of the spring 15 so as to support the spring 15.

A pinion returning spring 18, pinion stopper 19, and clip 20 are provided, with a load of the pinion returning spring 18 being set to a value less than a value of the sleeve spring 15. However, a load characteristic thereof is sufficient to return the pinion shaft 11 which has been advanced in a direction of the ring gear 22 of an engine. A roller spring 23 causes an initial engagement of the clutch and fixes the roller 5.

In the thus-arranged starter, the pinion engagement is performed in the manner described below. First, the pinion shaft 11 is advanced by a shift lever 21, and at the same time torque generated by the motor is transmitted from the armature gear 2 of the shaft 1 to the pinion 14 through the clutch gear 4 of the clutch outer means 3, the roller 5, the clutch inner means 6, the first helical spline 12, the pinion shaft 11, and the second helical splines 13. At this time, the torque of the motor as well as the advancing power of the shift lever 21 acts on the pinion 14, and thus the pinion 14 is engaged with a ring gear 22 of the engine.

Figure 5:
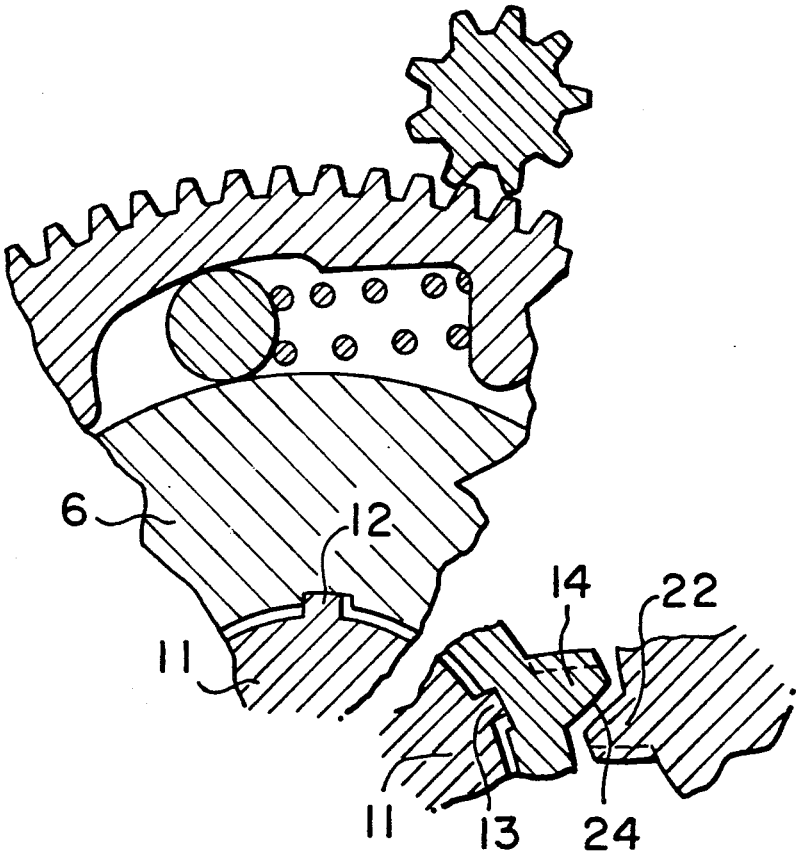

When the pinion 14 abuts against the corner portion of the ring gear 22, however, the advancing power of the shaft and the torque of the motor are not sufficient to engage the pinion 14 with the ring gear 22. More particularly, in a state shown in FIG. 3, the pinion 14 is in contact with the corner portion of the ring gear 22, the sleeve spring 15 is not deformed, and movement of the pinion shaft 11 in the axial direction by the shift lever 21 in this state causes the pinion 14 to shift in the direction opposite to that of rotation of the pinion shaft by the difference between angle $\theta_2$ of the second helical splines 13 and angle $\theta_1$ of the first helical splines 12 as shown in FIGS. 4 and 5. If the torque caused by the load of the sleeve spring 15 is set to a value larger than a value caused by the motor, the pinion 14 is shifted in the direction opposite to that of rotation of the pinion shaft 11 by the pinion 14, the ring gear 22, and an corner portion 24, and thus is engaged with the ring gear 22. Therefore, in this embodiment, the engagement range formed by the contacted portions of the pinion 14 and the ring gear 22 is enlarged, thereby greatly reducing the engagement errors and improving the reliability of engagement.

Although the illustrated embodiment includes some streaks of the first and second helical splines, respectively, it is evident that the number of the splines is immaterial, and, for example the structure in which the number of each of the first and the second helical splines is one can achieve the same results as the above embodiment.

The aforementioned embodiment enables a twostate engagement type starter with a reduction mechanism, e.g. a large type starter or the like, to adopt a dust prevention structure.

As will be understood from the foregoing description, in the present invention, since the engagement range formed by the contacted portions of the pinion 14 and the ring gear 22 is enlarged, the engagement errors are greatly reduced, and thereby a starter with a reduction mechanism which is greatly improved the engagement reliability can be provided.

What is claimed is:

1. A starter means for transmitting power of a motor to a pinon clutch engaged with a ring gear through a reduction mechanism, the pinion clutch including a pinion shaft mechanically coupled to an inner periphery of a clutch inner means of said pinion clutch in such a manner so as to be movable in an axial direction thereof, and a pinion provided at one end of said pinion shaft, at least a first helical spline means provided between said clutch inner means of said pinion clutch and said pinion shaft, and at least a second helical spline means provided at said one end of said pinion shaft such that said pinion shaft is mechanically coupled to said pinion through said second helical spline means, means for moving the pinion shaft in a direction of the ring gear, and means for preventing a forward movement of the pinion in the direction of the ring gear when said pinon is at a distal end of said pinion shaft, wherein said first helical spline means and said second helical spline means are rotatable in the same direction, and wherein an angle of twist of said second helical spline means is larger than an angle of twist of said first helical spline means.

2. A starter means for transmitting power of a motor to a pinion engaged with a ring gear through a pinion shaft, said pinion shaft including a first spline means for transmitting the power of the motor and a second spline means through which the pinion shaft engages with said pinion, said first spline means and said second spline means being rotatable in the same direction, an angle of twist of said second spline means being larger than an angle of twist of said first spline means, and wherein means are provided for preventing the pinion from moving forward on the pinion shaft in a direction of the ring gear and enabling the pinion to be movable rearwardly on the pinion shaft in a direction away from the ring gear with said pinion being provided on said pinion shaft at a distal end thereof.

3. A starter means according to claim 2, wherein said means for preventing includes a stopper means mounted at the distal end on the pinion shaft and a spring means for pressing the pinion against said stopper means.

4. A starter means according to claim 3, wherein said pinion shaft includes a supporting means disposed between a portion mounting the first spline means and a portion mounting the second spline means, wherein said supporting means is adapted to support said spring means.

5. A starter means according to claim 4, wherein said supporting means includes a washer mounted on said pinion shaft.

6. A starter means according to claim 5, wherein said washer projects in a direction of the pinion beyond an outer end surface of a housing of the starter means.

7. A starter means according to claim 2, wherein said first and second spline means includes helical splines.

8. A starter means for transmitting power of a motor to a pinion engaged with a ring gear through a reduction mechanism and a pinion shaft, wherein said pinion shaft includes a first spline means through which the pinion shaft engages with a reduction gear means included in the reduction mechanism, and a second spline means through which the pinion shaft engages with said pinion and which twists in a same direction as a twist direction of the first spline means with a larger angle of twist than said first spline means, and wherein means are provided for preventing the pinion from moving forwardly on the pinion shaft in a direction toward the ring gear and enabling the pinion to be movable backward in a direction away from the ring gear while said pinion is provided on said pinion shaft at a distal end thereof.

9. A starter means according to claim 8, wherein said means for preventing includes a stopper means mounted at the distal end on the pinion shaft and a spring means for pressing the pinion against the stopper means.

10. A starter means according to claim 9, wherein said pinion shaft includes a supporting means disposed between a portion mounting the first spline means and a portion mounting the second spline means, and wherein said supporting means is adapted to support said spring means.

11. A starter means according to claim 10, wherein said supporting means includes a washer mounted on said pinion shaft.

12. A starter means according to claim 11, wherein said washer is adapted to project in a direction beyond an outer end surface of a housing of the starter means.

13. A starter means according to claim 12, wherein said first and second spline means includes helical splines.

14. A starter means for transmitting power of a motor to a pinion engaged with a ring gear through a pinion shaft, said pinion shaft has a first spline means for causing the pinion move into a position for engagement with the ring gear and a second spline means twisting in the same direction as the first spline means at a larger angle of twist than said first spline means, so that the second spline means is adapted to cause the pinion rotate so as to engage with the ring gear with an edge surface thereof coming into contact with an edge surface of the ring gear and wherein means are provided for moving the pinion shaft in the direction of the ring gear.

15. A starter means for transmitting power of a motor to a pinion engaged with a ring gear through a reduction mechanism and a pinion shaft, wherein said pinion shaft includes a first spline means for causing the pinion move to a position for engaging with the ring gear and a second spline means twisting in the same direction as the first spline means and having a larger angle of twist than said first spline means so that said second spline means is adapted to cause the pinion rotate so as to engage with the ring gear with an edge surface thereof coming into contact with an edge surface of the ring gear.

16. A starter means according to claim 15, wherein said reduction means includes an outer means of a one-way clutch and a shaft of an armature.

17. A starter means for transmitting power of a motor to a pinion engaged with a ring gear through a pinion shaft of the starter means, wherein said pinion shaft engages with the pinion through a helical spline means, said pinion being disposed on the pinion shaft in such a manner so as to prevent the pinion from moving in a direction of engagement and to be movable in a direction away from the engaging direction.

18. A starter means for transmitting power of a motor through a first spline means and a second spline means through a pinion provided on a pinion shaft, said first spline means and second spline means being rotatable in a same direction, said second spline means having a larger angle of twist than said first spline means, wherein said first spline means guide said pinion to a position for engagement with a ring gear, and said second spline means causing said pinion rotate to engage said pinion with said ring gear in accordance with an advancing of the pinion shaft after said pinion contact said ring gear.

19. A starter means according to claim 18, including means for biasing said pinion shaft in an axial direction.

20. A starter means according to claim 19, including stopping means for preventing said pinion from moving in a forward direction toward said ring gear.

21. A starter means according to claim 20, further including a spring means for elastically pressing said pinion against said stopping means.

* * * * *